United States Patent [19]

Bellis

[11] Patent Number: 4,798,558

[45] Date of Patent: Jan. 17, 1989

[54] COIN DISPENSING APPARATUS WITH EJECTING MEMBER

[75] Inventor: Robert D. Bellis, Lancashire, England

[73] Assignee: Coin Controls Limited, Lancashire, England

[21] Appl. No.: 65,927

[22] Filed: Jun. 24, 1987

[30] Foreign Application Priority Data

Oct. 24, 1986 [GB] United Kingdom ..... 86-25531

[51] Int. Cl.[4] ..... G07D 1/00

[52] U.S. Cl. ..... 453/32; 453/33; 453/57; 453/58; 221/235

[58] Field of Search ..... 453/39, 40, 49, 57, 453/29, 30, 32, 33, 34, 35, 19, 20, 18, 58, 50, 51, 52; 221/68, 233, 234, 235, 263, 266, 206, 7, 79, 80, 81, 87, 88, 236

[56] References Cited

U.S. PATENT DOCUMENTS

| | | | |
|---|---|---|---|
| 1,110,263 | 9/1914 | Huntington | 453/57 |
| 2,054,552 | 9/1936 | Wakeham | 221/235 X |
| 2,881,774 | 4/1959 | Labbe | 453/57 X |
| 3,016,167 | 1/1962 | Richards, Jr. et al. | 221/266 X |
| 3,612,073 | 10/1971 | Calos | 453/32 |
| 4,036,242 | 7/1977 | Breitenstein et al. | 453/30 |
| 4,147,175 | 4/1979 | Webb | 453/58 X |
| 4,148,331 | 4/1979 | Nicolaus | 453/57 X |
| 4,407,312 | 10/1983 | Davila et al. | 453/32 |

FOREIGN PATENT DOCUMENTS

| | | |
|---|---|---|
| 0204405 | 12/1986 | European Pat. Off. . |
| 447950 | 5/1949 | Italy . |
| 513210 | 8/1952 | Netherlands . |
| 1445089 | 8/1976 | United Kingdom . |

*Primary Examiner*—Joseph J. Rolla
*Assistant Examiner*—Edward S. Ammeen
*Attorney, Agent, or Firm*—Wolf, Greenfield & Sacks

[57] ABSTRACT

Coin dispensing apparatus comprises a rotary disc 25 mounted on a baseplate 22 so as to rotate through coins in a hopper 1. Individual coins pass through holes 25 into coin receptacles between projections 8. The disc is rotated by a motor 4 through a reduction gear 6 and a drive gear 5. Coins 27, 28 in the receptacles are swept into engagement with a spring loaded finger 10 against the spring bias until they become aligned with an outlet 14. The spring bias then urges the coins outwardly through the outlet. The apparatus has particular application to amusement machines with payout.

17 Claims, 4 Drawing Sheets

FIG. 1.
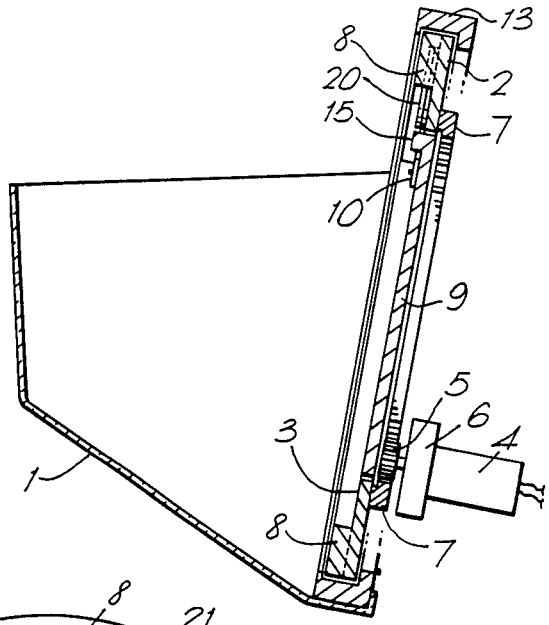
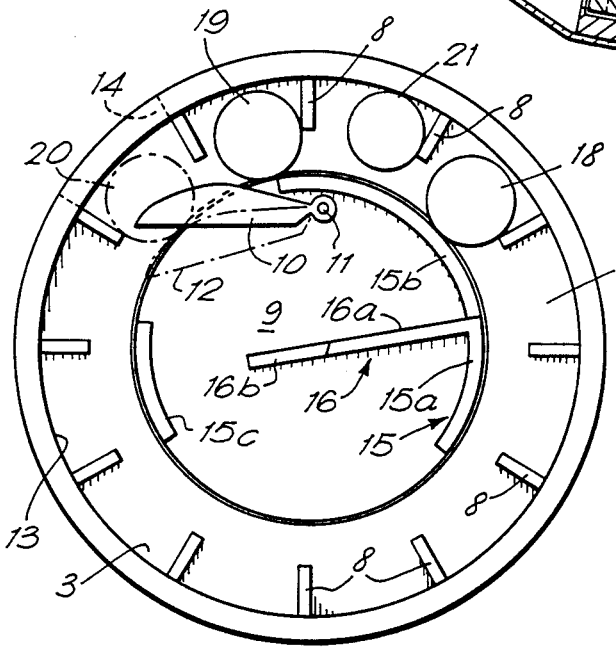
FIG. 2.

FIG.6B.
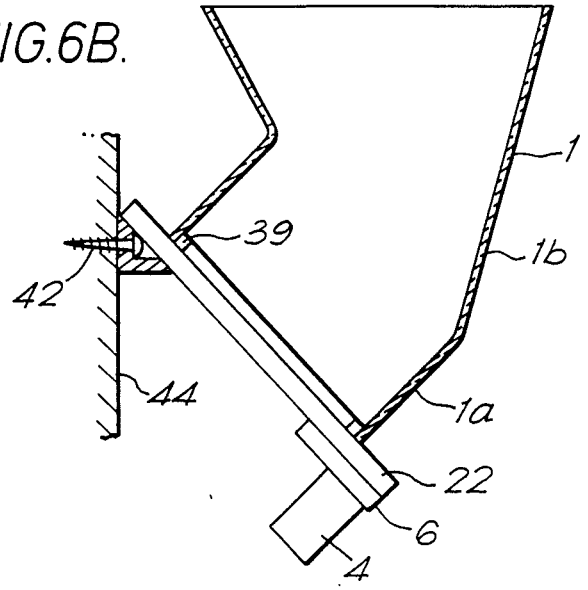
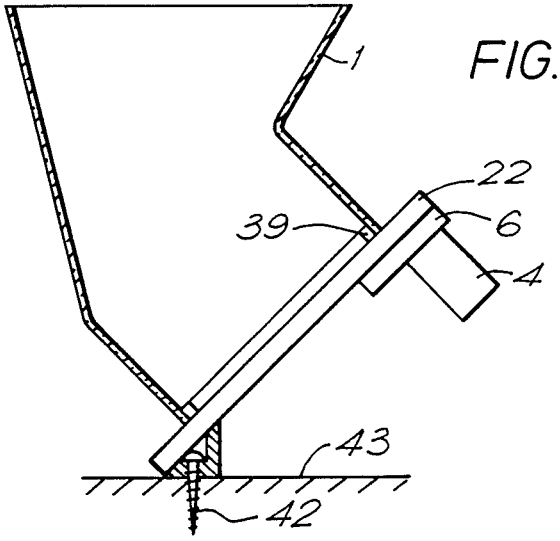
FIG.6A.

COIN DISPENSING APPARATUS WITH EJECTING MEMBER

FIELD OF THE INVENTION

This invention relates to coin dispensing apparatus and has particular application to coin dispensing hoppers.

BACKGROUND

Coin dispensing hoppers are known consisting of a disc set at an angle from the vertical, which is caused to rotate about its center by means of an electric motor, and on the flat face of the disc, towards the periphery thereof, is set a series of equally spaced projections. The lower part of the disc rotates through a hopper that receives a supply of coins and the spaces between the projections act as receptacles for single coins which are conveyed by the disc upwardly to a station where they are ejected and/or counted. One known method of ejecting the coins from the upper part of the disc utilizes a finger connected to a fixed frame at the top of the disc and spanning a part of its flat face. The finger drives the coins individually, radially upwardly of the disc. However, in order to permit the projections to pass the finger as the disc rotates, the finger is either formed with an arched section or is provided with a slot in its side nearest the disc. This known fixed finger arrangement restricts the range of diameters of coins which can be used in the apparatus and thus this known apparatus can only operate with a limited range of coin denominations.

Another problem with the known apparatus is that if a smaller coin is accidentally dropped into the hopper, it can jam the mechanism between the finger and an approaching projection.

A further problem with the known apparatus is that difficulties arise in causing each receptacle reliably to pick up a single coin as the disc is rotated through the hopper. In order to achieve a reliable pick up arrangement, it would be desirable to make the projections upstanding from the disc by relatively large amounts to produce stirring of the coins in the hopper. However if the projections were made of this size, they would not clear the ejection finger.

SUMMARY OF THE INVENTION

An object of the present invention is to overcome these problems.

According to the present invention there is provided a coin dispensing apparatus comprising a coin source, a rotary member, motor means for rotating the rotary member, coin receptacles disposed around the member to receive coins from the source, a coin outlet, and ejector means operative to move repetitively so as to engage coins in the receptacles successively as they pass the outlet and thereby cause ejection of the coins from the rotary member through the outlet.

As used herein, the term coin is intended to include both a coin and a token.

The apparatus according to the invention can operate with different size coins because the movable ejector means can readily accommodate and eject coins of different diameters. Also, the movable nature of the ejector means makes the apparatus less likely to jam.

Conveniently, the ejector means comprises a finger member urged by spring means to move outwardly of the annular member. Preferably the rotary member has a flat surface with an annular periphery and the receptacles are defined by projections upstanding from said surface, equally spaced around the periphery of the rotary member. An annular wall bounds the periphery of the annular member, the wall including an opening through which the finger member ejects the coins successively. In use, as the annular member rotates, coins are picked up by the projections from the coin source and as the coins successively approach the finger member, it is moved against the spring bias by the coin until the coin becomes aligned with the opening in the annular wall. Then, the energy stored in the spring urges the finger member outwardly so as to eject the coin through the opening.

The movable nature of the ejector means permits the projections to be upstanding from the flat face of the annular member by a plurality of coin thicknesses so that the projections pick up a column of coins. The ejector means can be configured to eject one coin in the column thus leaving a coin in the receptacle after coin ejection. In this way, reliable loading of coins in the receptacles is ensured because as the disc rotates for a second time the probability of a coin being present for ejection is very substantially increased.

Preferably, the rotary member has a flat annular surface set at an angle to the vertical and the coin source comprises a hopper through which the rotary member rotates.

In one embodiment, there is provided a baseplate with a recess to receive the rotary member, and wherein the rotary member comprises a disc formed with holes through which coins pass into the receptacles. Desirably, the disc is interchangeable for use with coins of different denomination.

Conveniently, pick-off means are provided to remove at least one uppermost coin in a coin column held by the receptacles as they move upwardly, the pick-off means being arranged to feed the picked-off coins back into other ones of the receptacles thereby to ensure reliable filling of the receptacles with coins.

Preferably, the pick-off means is arranged to pick-off a plurality of coins from the column and feed them to respective different receptacles.

BRIEF DESCRIPTION OF THE DRAWINGS

In order to that the invention may be more fully understood two embodiments thereof will now be described by way of example with reference to the accompanying drawings in which:

FIG. 1 is a schematic sectional view of a coin dispensing apparatus according to the invention;

FIG. 2 is a schematic view of the front face of the apparatus;

FIGS. 6A and 6B illustrate schematically how the coin dispensing apparatus of FIGS. 4 and 5 can be attached to horizontal and vertical support surfaces respectively.

DESCRIPTION OF EMBODIMENTS

Figure 3:
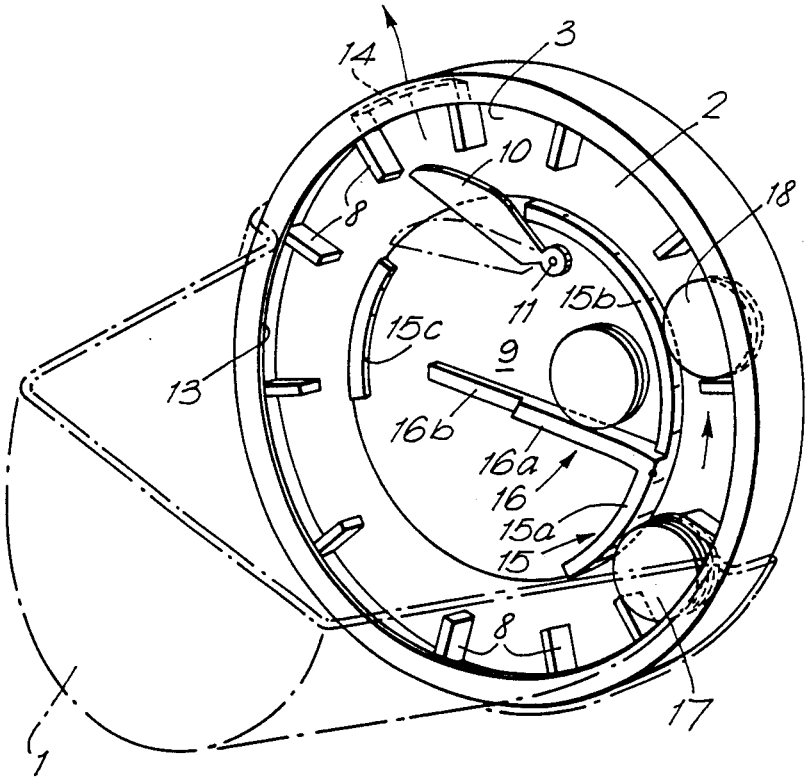
FIG. 3 is a schematic perspective view of the apparatus shown in FIGS. 1 and 2.

The embodiment shown in FIGS. 1 to 3 comprises a coin dispensing hopper for use in gaming machines e.g. for use as a coin payout mechanism in an amusement machine with payout.

Coins from a coin validator (not shown) feed into a hopper 1 which acts as a coin source. A rotary member 2 having a flat face 3 and an annular periphery is rotated through the hopper 1 by means of a dc electric motor 4 that drives a gear 5 through a reduction gearbox 6, the gear 5 meshing with a circular toothed ring 7 mounted on the back of the rotary member 2. The front face 3 of the member 2 is provided with equally spaced upstanding projections 8 that extend radially inwardly from the outermost annular periphery of the member 2. The spaces between the projections 8 define receptacles that receive coins from the hopper 1 as will be explained in more detail hereinafter. The projections 8 are upstanding from the face 3 of the annular member by an amount corresponding to four coin thicknesses.

The annular member 2 has a central opening therein which is filled by a stationary generally disc shaped central member 9. Ejector means in the form of a finger member 10 of a thickness of one coin or less, is pivotally mounted about an axis 11 on the stationary central member 9. Referring to FIG. 2, the finger member 10 is biased by a spring (not shown) to assume the position shown in solid outline. However, the member 10 can move inwardly to the position shown in hatched outline 12.

The exterior periphery of annular member 2 is bounded by an annular wall 13 that is provided with an opening 14 through which coins are ejected.

The exterior periphery of central member 9 is bounded by a guide wall 15 which has a first portion **15*a* of a height corresponding to four coin thicknesses, that steps down to a portion 15*b* of height corresponding to two coin thicknesses. Coin pick-off means in the form of a coin rundown path 16 has a first portion 16*a* of two coin thicknesses and a second portion 16*b*** of one coin thickness.

In use, the motor 4 rotates the annular member 2 causing the projections 8 to pass through the hopper 1 thereby picking up coins in the receptacles. Since the projections 8 have a height corresponding to four coin thicknesses, they tend to stir the coins in the hopper to facilitate loading into the receptacles. Each of the receptacles thus tends to pick up a column of four coins for example as shown by reference 17 in FIG. 3. This column of four coins will move upwardly, guided between wall 15 and outer wall 13. When the column reaches the coin pick-off means 16, the uppermost two coins roll down path 16, leaving two coins remaining in the receptacle. The coins passing down path 16 are fed back into receptacles at the bottom of the annular member 2, the uppermost coin on the path 16 sliding over the wall portion **16*b* whereas the lowermost coin runs to the edge of portion 16*b* and then falls downwardly. Thus the two coins are returned to the receptacles at spaced apart locations so that they will tend to feed into different receptacles. This arrangement ensures that the receptacles at the lowermost part of the annular member 2 are reliably filled in the event that the projections 8 do not themselves pick out coins from the coin mass in the hopper 1**.

The two remaining coins in the column 17 are then guided upwardly between wall portion **15*b* and the annular wall 13. These remaining two coins are shown by reference 18 in FIGS. 2 and 3. These two coins are then moved into position 19 (FIG. 2) where they engage the finger member 10**.

The finger member 10 is moved progressively radially inwardly against the spring bias as a result of the coins 19 engaging it. Consequently the member 11 assumes the position 12 shown in hatched outline as the coins move to the position 20 also shown in hatched outline. The coins are then aligned with the opening 14, which has a thickness of one coin only. Consequently the energy stored in the spring urges finger member 10 radially outwardly and pushes the lowermost coin radially outwardly through the opening 14, thereby ejecting it. The rotary member 2 continues to rotate so that the uppermost coin remains in the receptacle and passes downwardly between wall portion 15c and the annular wall 13.

Thus, one of the coins is ejected whilst the other remains in the receptacle thereby ensuring reliable filling of the receptacle.

Thus, as the motor 4 rotates the rotary member 2, coins are successively ejected from each of the receptacles by the finger member 10 as the receptacles pass the opening 14.

The coin dispensing apparatus shown in the drawings has the advantage that it will operate reliably with coins of different diameters. For example, referring to the coin 21 shown in FIG. 2, the finger member will reliably eject this coin because although the coin is of reduced diameter it will still cause the finger member 10 to be biased inwardly so that as the coin reaches the opening 14, the energy stored in the spring will cause member 10 to move radially outwardly and eject the coin through the opening.

The apparatus of the invention has the advantage that the projections 8 pass between the annular wall 13 and the finger member 11 without the need to provide an arch in the finger member or the need to provide slots in it.

Figure 4:
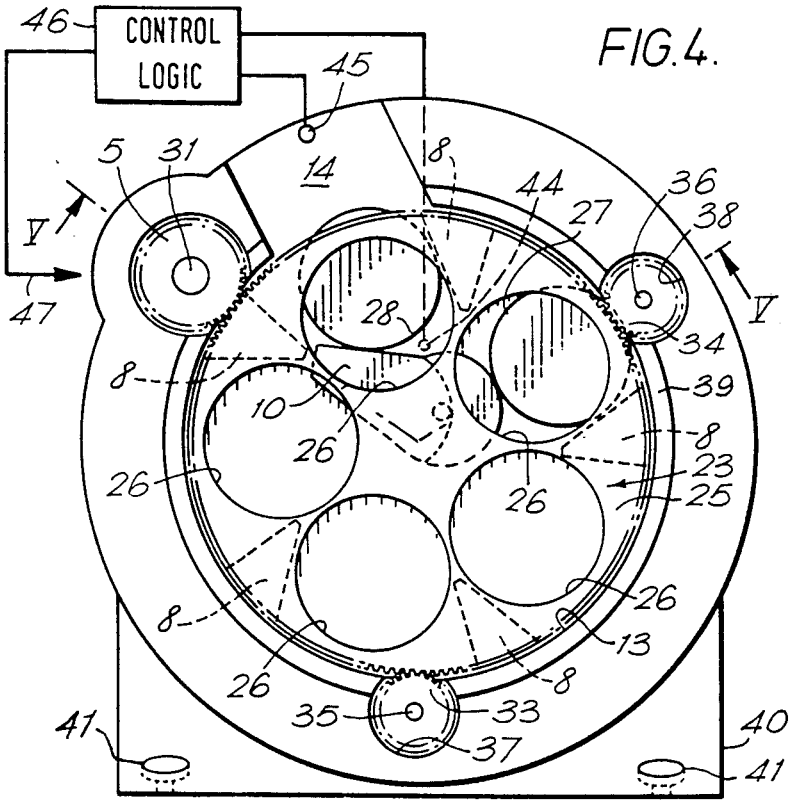
FIG. 4 is a schematic view of the front face of another embodiment of the invention, with its hopper removed.
Figure 5:
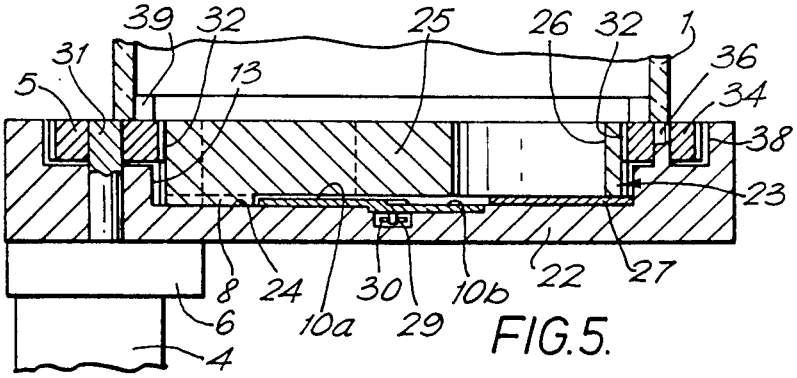
FIG. 5 is a sectional view taken along the line V - V of FIG. 4.

FIGS. 4 to 6 show another embodiment of the invention for use in gaming machines.

The apparatus consists of a baseplate 22 which includes a circular recess 23 having a circular coin slide surface 24 bounded by annular wall 13. The coin slide surface 24 is coplanar with an outlet 14 through the annular wall 13.

The rotary member 2 consists of a circular disc 25 received in the recess 23. A number of coin entrance holes 26 extend through the disc 25. Projections 8 are disposed around the disc 25 on the side which contacts the coin slide surface 24, the spaces between the projections 8 thus providing receptacles to receive coins that enter the space between the disc 25 and the surface 24 through the coin entrance holes 26 from hopper 1. Two such coins 27, 28 are shown in Figure 4.

Finger member 10 is rotatably mounted in the base plate 22 so as to have an arm portion **10*a* that slides over the surface 24 and a portion 10*b* which is coplanar with the surface 24. Finger member 10 is mounted on a pin 29 around which extends a coil spring 30** that biases the finger member radially outwardly.

The disc 25 is rotated by means of a gear 5 driven by electric motor 4 through gearbox 6 and an output shaft 31. The gear 5 meshes with teeth 32 formed on the circular periphery of the disc 25. Additionally idler wheels 33,34 mesh with the teeth 32, the idler wheels being rotatably supported on axial pins 35,36 integrally moulded in sockets 37,38 in the base plate 22. Thus, the idler wheels 33, 34 together with the drive gear 5 provide a peripheral rotary support for the disc 25.

The circular wall 13 is provided with an upstanding lip 39 onto which the hopper 1 is push-fitted. As can be seen from FIG. 6, the hopper 1 has a cylindrical portion 1a which leads into an outwardly flared conical portion 1b.

The base plate 22 is formed with an integral mounting flange 40 which is configured to support the baseplate at an inclined angle conveniently 45°. Screw holes 41, permit the apparatus to be mounted by screws 42 onto either a horizontal surface 43 as shown in Figure 6A or onto a vertical surface 44 as shown in FIG. 6B. The same hopper 1 can be used for both configurations by rotating it about the lip 39 to assume the configuration shown in either FIG. 6A or 6B. If necessary, the hopper 1 may additionally be retained on the baseplate 22 by means of locating screws or bolts (not shown).

In use, when the apparatus is installed in a gaming machine, coins fall into the hopper 1. When a payout occurs, the motor 4 is operated so as to rotate the disc 25. Coins from the hopper 1 become captured in the holes 26 in the disc and pass onto the coin sliding surface 24 to take up positions between the projections 8. The space between the disc 25 and the surface 24 is so arranged that only one coin can enter between each pair of projections 8. The disc 25 is rotated clockwise so that the coins are swept into engagement with the spring loaded finger 10 to bias it radially inwardly. When a coin such as coin 28 reaches the outlet 14, the finger 10 can rotate radially outwardly to eject the coin through the outlet 14.

When the apparatus is used in a gaming machine, it is important that the number of coins paid out is accurately monitored to ensure that over payment does not occur. To this end, the apparatus includes first and second sensors 44, 45 (FIG. 4) conveniently in the form of photosensors, which detect the passage of coins to and through the outlet 14. The first sensor 44 is disposed to detect movement of FIG. 10 which indicates that a coin is approaching outlet 14. The second sensor 45 is arranged to detect a coin as it is ejected from the outlet 14. The outputs from the photosensors are fed to control logic 46 which may comprise part of a system processor for the gaming machine, which provides an output on line 47 for controlling energization of the motor 4.

In use, the control logic 46 may receive a command from other control circuitry (not shown) indicating the number of coins to be paid out. The control logic is arranged to provide an output on line 47 to drive the motor until a predetermined number of outputs is produced by the sensor 45 to indicate payout of the correct number of coins. Actual payout can be checked by determining that each output from the sensor 44 is thereafter accompanied by a corresponding output from sensor 45. When the sensor 44 produces the last output for the last coin to be paid out, the control logic provides an output on line 47 to slow down the motor 4. When sensor 45 detects that the last coin has actually been paid out, the control logic 46 provides the command on line 47 for the motor to stop. In this way, over-run of the motor is prevented so as to prevent spurious overpayment.

In an alternative arrangement, not shown, a single coin sensor may be provided and the control logic is so arranged that for the payout of the majority of the coins the motor is operated at a fast rate but for the last coin or the last several coins, the motor is slowed down and operated at a slow rate prior to stopping finally.

From the foregoing it will be appreciated that the apparatus shown in FIGS. 4 to 6 is of a simple construction in which the disc 25, the baseplate 22 and the gears 5, 33 and 34 can be moulded in plastics material. Furthermore, the rotational mounting of the discs 25 is of a simple construction which permits the disc to be readily interchanged. Thus, a range of discs 25 can be provided with different diameter coin entrance holes 26 for use with different coin denominations. Typically, discs 25 with 3,4,5 and 6 holes 26 will be provided. To interchange the disc 25, the hopper 1 is removed, the disc 25 is lifted from the recess 23 and another disc inserted.

Many modifications and variations fall within the scope of the invention are possible. For example, the control logic 46 may be arranged to reverse rotation of the annular member 2 in the event that the apparatus becomes jammed, so as to clear the jam and then to continue rotation in the desired direction.

In the described embodiments, the ejector means includes a finger member 10 pivotably mounted about an axis 11 or pin 29. In an alternative embodiment, the ejector means could comprise a cam slidably mounted along a radially extending axis, the cam being spring biased radially outwardly to achieve the same function as the finger member 10 discussed hereinbefore. Alternatively, instead of being spring biased, the finger member 10 could be operated by means of a solenoid in response e.g. to the output from sensor 44, so as to operate in response to the next approaching receptacle containing a coin. Also, the ejector means could eject coins radially inwardly through a centrally disposed outlet, rather than radially outwardly.

Further, it will be appreciated that the optical sensors 44, 45 could be replaced by Hall effect devices inductive coils, or other sensor means.

In addition, the face of the disc 25 may be scalloped or otherwise provided with coin stirring means to guide coins from the hopper into the holes 26.

I claim:

1. A coin dispensing apparatus comprising:

a coin source;

a rotary member;

a plurality of projections disposed around the rotary member to define receptacles;

means for feeding coins from the coin source into the receptacles;

means for rotating the rotary member to move coins in the receptacles along an annular coin path;

a coin outlet disposed radially to one side of the annular coin path;

a movable ejector member positioned on the side of said coin path opposite said one side; and means for biasing said ejector member radially of the coin path toward said coin outlet, said ejector member being spaced from said coin outlet such that said ejector member is moved against the action of said biasing means by a coin in a receptacle as the coin approaches the outlet, the biasing means being operative when the coin reaches the outlet to cause the ejector member to eject the coin radially of the coin path and through the outlet;

said projections and ejector member being so arranged and dimensioned that each projection passes unimpeded between the ejector member and the outlet upon rotation of the rotary member.

2. Apparatus according to claim 1 wherein said ejector member includes a finger member, and said biasing means includes means for urging the finger member outwardly of the rotary member in a direction of said coin outlet.

3. Apparatus according to claim 2 wherein said means for urging includes spring means urging the finger member in said direction of the coin outlet.

4. Apparatus according to claim 1 wherein the rotary member has a flat surface with an annular periphery and the receptacles are defined by said projections upstanding from the surface around the periphery thereof, an annular wall bounds the periphery of said surface, and the outlet comprises an opening in the annular wall through which coins are ejected successively.

5. Apparatus according to claim 1 wherein the receptacles are each configured to receive a plurality of coins in a column, and wherein said ejector member is operative to eject successively one coin from the column in each receptacle, whereby a coin may be left in the receptacle after coin ejection.

6. Apparatus according to claim 5 wherein a flat surface of the rotary member is set at an angle to the vertical, and the coin source comprises a hopper through which the rotary member rotates.

7. Apparatus according to claim 6 including a mounting flange for mounting the apparatus either on the vertical or on a horizontal mounting surface.

8. Apparatus according to claim 7 wherein the hopper may be mounted in a first or a second operative position when said apparatus is mounted on a vertical or a horizontal support surface respectively.

9. Apparatus according to claim 5 including pick-off means to remove at least one coin in a coin column held by the receptacles as they move upwardly, the pick-off means being arranged to feed the picked off coins back into other ones of the receptacles.

10. Apparatus according to claim 4 including teeth provided around the rotary member, a drive gear in meshing engagement with the teeth, and wherein said means for rotating includes an electric motor that drives said drive gear.

11. Apparatus according to claim 10 including a plurality of idler gears disposed at the periphery of the rotary member and engaging said teeth.

12. Apparatus according to claim 1 including a baseplate with a recess to receive said rotary member, and wherein said rotary member comprises a disc formed with holes through which coins pass into said receptacles.

13. Apparatus according to claim 12 including means for permitting said disc to be removed and replaced with another disc.

14. Apparatus according to claim 1 including control means for controlling said means for rotating to cause ejection of a predetermined number of coins.

15. Apparatus according to claim 14 including sensor means for sensing said coin ejections.

16. Apparatus according to claim 15 wherein said sensor means includes a first sensor for sensing the approach of a coin to the outlet, and a second sensor for detecting the passage of a coin through the outlet.

17. Apparatus according to claim 16 wherein said control means includes means for slowing the speed of said means for rotating when the first sensor detects that a predetermined number of coins has approached said outlet, and means for stopping the means for rotating when said second sensor provides an indication that said predetermined number of coins has passed through said outlet.

* * * * *